US005519895A

United States Patent [19]

Barnes, Jr.

[11] Patent Number: 5,519,895

[45] Date of Patent: May 28, 1996

[54] CAP FOR SPORTS HELMET

[76] Inventor: Montie M. Barnes, Jr., c/o Undercover Sports, 39899 Balentine Dr., #325, Newark, Calif. 94560

[21] Appl. No.: 377,682

[22] Filed: Jan. 24, 1995

Related U.S. Application Data

[63] Continuation of Ser. No. 189,428, Jan. 31, 1994, abandoned, which is a continuation-in-part of Ser. No. 53,774, Apr. 28, 1993, abandoned.

[51] Int. Cl.[6] ..... A42B 3/00

[52] U.S. Cl. ..... 2/422; 2/425

[58] Field of Search ..... 2/410, 411, 422, 2/425, 421, 175.1, 175.2, 175.3, 195.1, 195.3, 209.13, 205

[56] References Cited

U.S. PATENT DOCUMENTS

| | | | |
|---|---|---|---|
| 1,868,926 | 7/1932 | Tatore et al. | 2/425 |
| 3,103,015 | 9/1963 | Plastino . | |
| 3,155,981 | 11/1964 | McKissick et al. . | |
| 3,203,003 | 8/1965 | Plastino . | |
| 3,263,235 | 8/1966 | Young . | |
| 4,106,124 | 8/1978 | Green | 2/187 |
| 4,599,752 | 7/1986 | Mitchell | 2/425 |
| 4,662,007 | 5/1987 | Lipkin | 2/195.1 |
| 4,704,746 | 11/1987 | Nava | 2/425 |
| 4,901,373 | 2/1990 | Broersma | 2/421 |
| 4,937,888 | 7/1990 | Straus | 2/411 |
| 5,099,524 | 3/1992 | Linday | 2/181 |
| 5,173,970 | 12/1992 | Shifrin | 2/410 |
| 5,226,180 | 7/1993 | Leach | 2/411 |
| 5,289,591 | 3/1994 | Andersen | 2/195.5 |

*Primary Examiner*—Michael A. Neas

*Attorney, Agent, or Firm*—Julian Caplan; Flehr, Hohbach, Test, Albritton & Herbert

[57] ABSTRACT

A baseball type cap for over a conventional sports helmet (e.g., for bicyclists). An elastic band is sewn or otherwise affixed to the bottom edge of the cap. The band fits against the bottom edge of the helmet to hold the cap in place. When the cap is removed from the helmet, it can be worn on the head. For such use the band is folded inward to a position parallel to the lower edge of the cap. The elastic band fits tight against the head. Thus, although the cap is necessarily larger than the head, the elastic holds it in place.

5 Claims, 2 Drawing Sheets

CAP FOR SPORTS HELMET

CROSS REFERENCE TO RELATED APPLICATIONS

This is a continuation of application Ser. No. 08/189,428 filed Jan. 31, 1994 now abandoned which is a continuation-in-part of application Ser. No. 08/053,774 filed Apr. 28, 1993 now abandoned.

BACKGROUND OF THE INVENTION

1. Field of the Invention

This invention relates to a new and useful improvement in sports helmet and more particularly to the provision of a baseball-type cap or other cap which is detachably secured to the helmet. Further, when the cap is removed from the helmet, it may be worn separately. An elastic band on the bottom edge of the cap, which secures the cap to the helmet, acts as a hatband to cause the cap to fit on the head of the wearer.

2. Description of Related Art

Sports helmets of the type used with the present invention are well known in the art. For safety reasons, such helmets are required. The present invention provides a cap fitting over the helmet which may resemble a baseball cap or other type of conventional head gear. Use of such head gear over the helmet disguises the fact that a helmet is being worn.

Baseball caps have, of course, been well known in the art for many years. The present cap is altered in that a relatively wide elastic band is stitched to the bottom edge of the cap. The band serves two functions. When the cap is attached to a helmet, the band lies against the bottom edge of the helmet and conveniently secures the cap in place. When the cap is detached, the elastic band fits inside the bottom edge of the cap and bears against the wearer's head, thereby accommodating the fact that the head size of the wearer is considerably less than the size of the cap.

SUMMARY OF THE INVENTION

A sports helmet is provided having a relatively thick wall, the bottom edge of which is preferably flat. Such helmets are secured on the head by means of strap arrangements and buckles so that even young children can conveniently secure the helmet on the head. Many children object to wearing protective helmets. The present invention provides a baseball type cap fitting over the helmet which disguises the fact that the helmet is being worn.

Accordingly one of the objects of the present invention is to make it more palatable for youngsters to wear protective helmets and even to make the wearing of such a helmet a matter of fashion. A baseball cap is secured over the helmet, thereby making the ensemble attractive, particularly when team logos, etc. are applied to the cap or to the cap bill.

In accordance with the present invention, the cap is detachably secured to the helmet. A preferred means is by stitching or otherwise affixing a relatively wide band of elastic tape to the bottom edge of the cap. Such an elastic band preferably fits against the flat bottom edge of the helmet. The cap is thus held taut.

In case the user wishes to wear the cap without the helmet, because of the elasticity of the elastic band, it tends to contract and lie against the underside of the cap. Thus it is interposed between the cap and the head of the wearer and acts as a headband. It will be understood that because of the thickness of the helmet wall, the cap is necessarily of a larger size than the head of the wearer. The elastic band accommodates this difference in size.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are net intended to limit the invention to those embodiments. On the contrary, the invention is intended to cover alternatives, modifications and equivalents, which may be included within the spirit and scope of the invention as defined by the appended claims.

Figure 3:
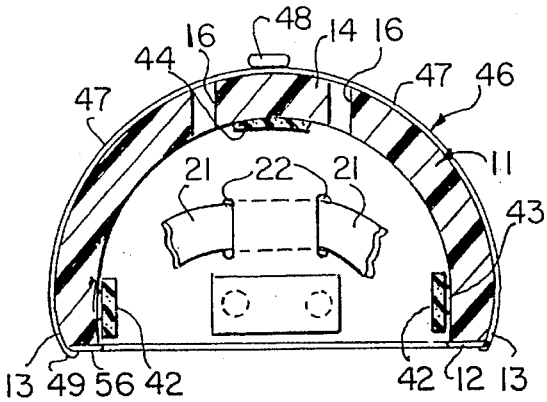
FIG. 3 is a vertical side elevational view taken substantially along the line 3—3 of FIG. 2.

Helmet 11 is preferably formed of a light weight, thick-walled plastic material. Viewed in plan (FIG. 2) it is generally oval. In cross section (FIG. 3) it is approximately half of an oval. It will be understood that the details of the helmet 11 shown herein are subject to considerable variation but that the particular helmet illustrated has been found to be particularly suitable for use with the cap 46 hereinafter described.

Helmet 11 may be manufactured in various sizes to accommodate different head sizes.

The bottom edge 12 of the walls of the helmet 11 are flat and approximately horizontal. The outside surfaces 13 adjacent the bottom edge 12 slant inward so that the edge 12 is preferable somewhat thinner than the wall thickness adjacent the crown 14. Ventilation holes 16 in any desired pattern may be formed adjacent crown 14.

Straps are used to hold the helmet on the head. In the particular form shown in the drawings, back strap 21 fits through horizontally spaced apart vertical slots 22 in the wall of the helmet. On the exterior, between the slots 22, a depression 23 is formed approximately as deep as the thickness of strap 21 so that when the cap 46 is applied, there is no unevenness or irregularity apparent. Front strap 26 passes through slots 27 in the front wall of helmet 11, and there is a similar depression 28 on the exterior between the slots 27 approximately the depth of the strap 27 so that the outer surface of the strap is approximately flush with the outer wall of the helmet to either side of depression 28.

Figure 1:
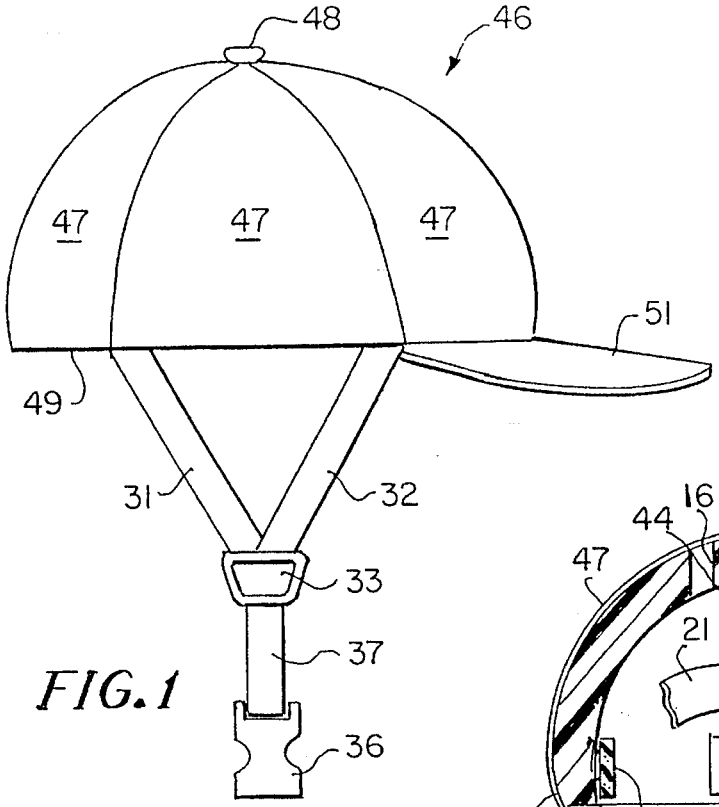
FIG. 1 is a side elevational view of a helmet with cap applied thereto.

On each side of the helmet an end 31 of the back strap and an end 32 of the front strap are brought together by a commercially available connector 33. A commercially available femme buckle 36 is installed at the bottom of the loops 37 of straps 31 and 32 on one side. On the opposite side there is a male buckle (not shown) connected to the two ends of the front and back straps in similar manner to that shown in FIG. 1. The male buckle is inserted in the female buckle to hold the helmet 11 on the head.

Figure 2:
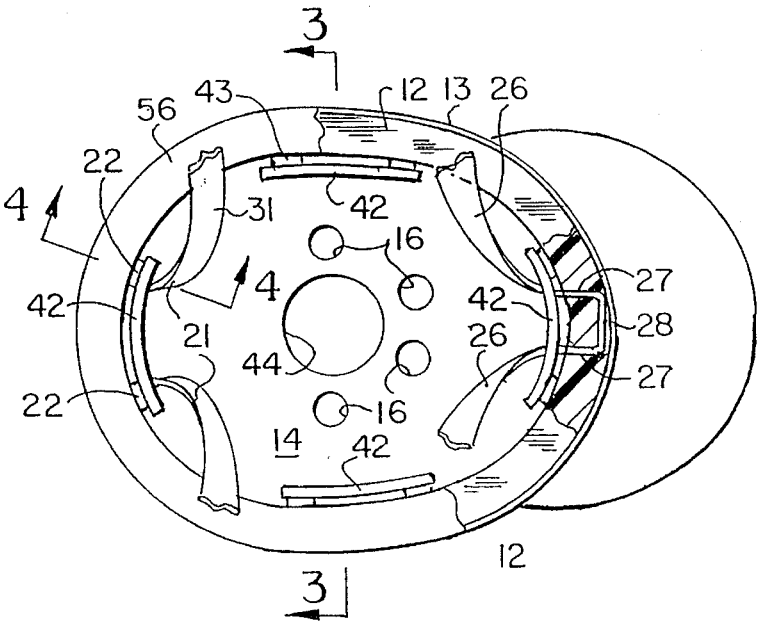
FIG. 2 is a bottom plan view of the structure of FIG. 1 with the straps being partly broken away and further with the elastic band partially broken away and the front wall of the helmet being partially broken away.
Figure 4:
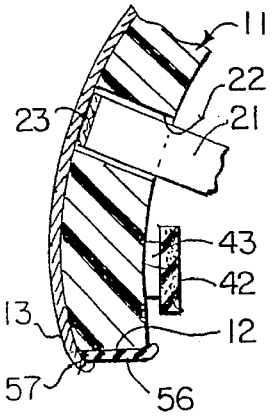
FIG. 4 is an enlarged sectional view taken substantially along the line 4—4 of FIG. 2.

Pads 42 are attached to the inside of the wall of the helmet at various locations by means of adhesive 43 to cushion the wearer's head against impact if the helmet is struck for any reason. As best shown in FIG. 2, there is a pad 42 at front, back, and either side. A center pad 44 may be applied at the top. It will be understood that the positions and thicknesses of the pads are subject to a wide variation. The pads may be used to adjust the helmet to accommodate different head sizes of the wearer.

Cap 46 is likewise subject to considerable variation. In the accompanying illustrations cap 46 is a baseball type cap and may have team insignia and other decorations (not shown). Various other hat shapes may be used, such as cowboy hat, sun hats, etc. In the cap 46 shown in the accompanying drawings, there is a plurality of upward tapering panels 47 sewn together at their adjacent edges. Frequently a button 48 is attached at the top where the panels 47 intersect. The panels 47 have a common horizontal bottom edge 49. In accordance with conventional baseball type caps, a bill 51 may extend outwardly at one position of the cap 46. Of course, many times the wearer puts the bill 51 at the back instead of the front.

In accordance with the present invention, an elastic band 56 is attached to the bottom edge 49 of the panels 47 and also to the inner edge of bill 51 by stitching 57. When the cap 46 is applied to the helmet 11, the elastic band 56 lies underneath the bottom edge 12 of the helmet 11. By reason of the inward slanted portion 13, the cap is drawn fight against the helmet. Since the straps 21 and 26 extend through depressions 23 and 28 respectively, the smooth fit of the cap is not distorted.

Figure 5:
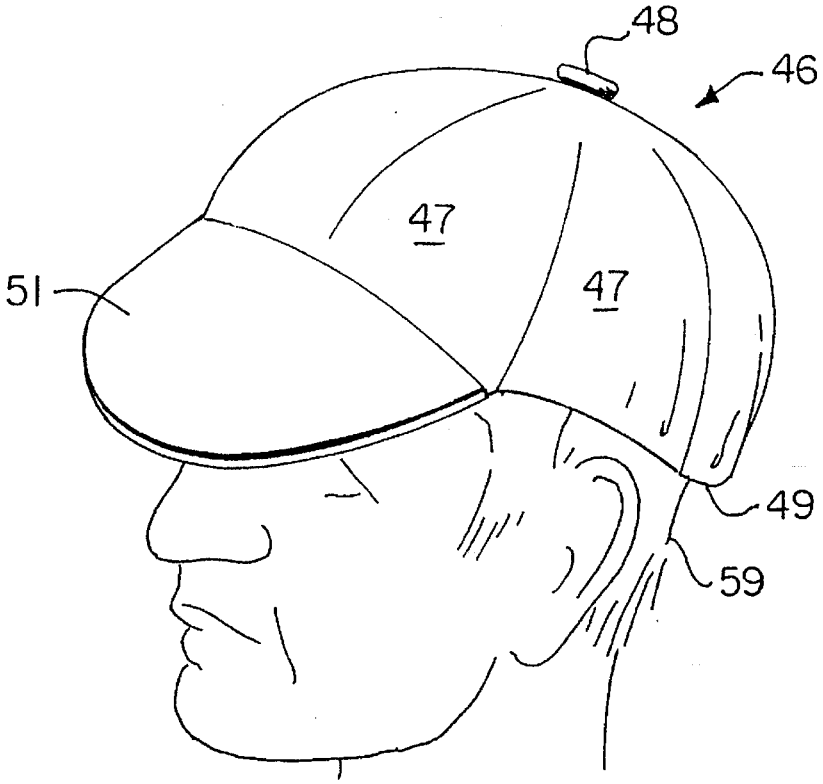
FIG. 5 is a perspective view showing the cap being worn without the helmet.
Figure 6:
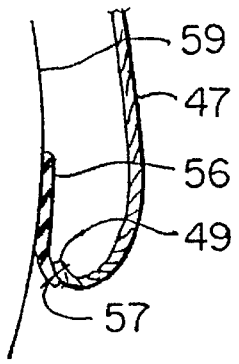
FIG. 6 is an enlarged sectional view taken substantially along the line 6—6 of FIG. 5.

Directing attention to FIG. 5, when the helmet 11 is not being worn, the cap 46 may be worn on the head 59. As best shown in FIG. 6, because of the elasticity of the band 56, it tends to cud up inside the cap panel 47 and exert pressure on the side of the head 59, thereby holding the cap in place.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a protective sports helmet having a thick wall shaped to fit over the head of the wearer having a substantially co-planar helmet bottom edge, said helmet bottom edge comprising a wide, flat surface and a fabric cap dimensioned to fit over said helmet and having a cap co-planar bottom edge extending down to said helmet bottom edge and means detachably retaining said cap on said helmet, said means detachably retaining said cap comprising a wide, flat band of elastic tape of a width substantially equal to that of said helmet bottom edge and means securing an edge of said band to said cap bottom edge, said band lying flat engaging substantially all of said flat surface, said band being positioned approximately perpendicular to said cap bottom edge.

2. The combination of claim 1 in which said thick wall has an exterior tapering downward-inward adjacent said helmet bottom edge.

3. The combination of claim 1 in which said cap comprises a plurality of triangular segments tapering upward from said cap bottom edge to a top, adjacent edges of said segments being sewn together.

4. The combination of claim 1 in which said cap has a bill projecting outward from said cap bottom edge.

5. The combination of claim 1 which further comprises at least a front chin strap for said helmet, said helmet being formed with a pair of horizontally spaced vertical slots, said helmet having an exterior formed with a depression between said slots, said chin strap coming from the interior of said helmet out through one said slot along said depression, then in through a second said slot into said interior of said helmet, said cap overlying the portion of said strap within said depression without any bulge over said depression.

* * * * *